US009565961B1

(12) United States Patent
Kirschner, Sr.

(10) Patent No.: US 9,565,961 B1
(45) Date of Patent: Feb. 14, 2017

(54) MAILBOX WITH DELIVERY INDICATOR

(71) Applicant: Richard V. Kirschner, Sr., Irving, TX (US)

(72) Inventor: Richard V. Kirschner, Sr., Irving, TX (US)

( * ) Notice: Subject to any disclaimer, the term of this patent is extended or adjusted under 35 U.S.C. 154(b) by 0 days.

(21) Appl. No.: 14/873,354

(22) Filed: Oct. 2, 2015

Related U.S. Application Data

(60) Provisional application No. 62/058,782, filed on Oct. 2, 2014.

(51) Int. Cl.
*A47G 29/122* (2006.01)

(52) U.S. Cl.
CPC ..... *A47G 29/1225* (2013.01)

(58) Field of Classification Search
CPC ... A47G 29/121; A47G 29/1225; A47G 29/30
USPC ..... 232/35
See application file for complete search history.

(56) References Cited

U.S. PATENT DOCUMENTS 2,573,879 A * 11/1951 Seibel ..... A47G 29/121 232/35
2,754,051 A * 7/1956 Shellabarger ..... A47G 29/1212 232/35
3,026,024 A * 3/1962 Holmgren ..... A47G 29/121 232/35
3,026,025 A * 3/1962 Hanson ..... A47G 29/121 232/35
3,318,516 A * 5/1967 Scheerer ..... A47G 29/121 232/35
3,606,141 A * 9/1971 Taylor ..... A47G 29/121 232/35
3,675,845 A * 7/1972 Scheerer ..... A47G 29/121 116/215
4,706,880 A * 11/1987 Peters ..... A47G 29/121 232/35
5,927,596 A * 7/1999 Trenier ..... A47G 29/121 232/17
7,337,945 B1 * 3/2008 Riggs ..... A47G 29/121 232/35

* cited by examiner

*Primary Examiner* — William Miller
(74) *Attorney, Agent, or Firm* — Kenneth L. Tolar

(57) ABSTRACT

A mailbox includes a hollow housing having a rear wall, an outer wall and an open front in communication with an interior mail receptacle. Within the mail receptacle is an actuator that deploys a delivery indicator when the access door is opened. Accordingly, when a mail carrier opens the door, the indicator automatically pivots downwardly to a vertical position, extending below the bottom surface of the housing, to conspicuously notify a user that mail has been delivered. The released indicator also exposes a textual alert message inscribed on the housing rear wall.

4 Claims, 2 Drawing Sheets

MAILBOX WITH DELIVERY INDICATOR

CROSS REFERENCE TO RELATED APPLICATIONS

This application is entitled to the benefit of provisional patent application No. 62/058,782 filed on Oct. 2, 2014, the specification of which is incorporated herein by reference.

BACKGROUND OF THE INVENTION

The present invention relates to a mailbox having an indicator that automatically deploys when mail is delivered.

DESCRIPTION OF THE PRIOR ART

Because a mail recipient cannot readily determine whether mail has been delivered, he or she often repeatedly travels to and from the box to inspect its contents. Repeatedly walking to and from a mailbox is annoying, particularly in inclement weather or if the mailbox is in a remote location. Accordingly, there is currently a need for a mailbox that allows a user to readily determine when mail has been delivered. The present invention addresses this need by providing a mailbox having an automated indicator that deploys when a mail carrier opens an access door.

SUMMARY OF THE INVENTION

The present invention relates to a mailbox comprising a hollow housing having a rear wall, an outer wall and an open front in communication with an interior mail receptacle. Within the mail receptacle is an actuator for deploying a delivery indicator when the access door is opened. Accordingly, when a mail carrier opens the door, the indicator automatically pivots downwardly to a vertical position, extending below the bottom surface of the housing, to conspicuously notify a user that mail has been delivered. The released indicator also exposes a textual alert message inscribed on the housing rear wall.

It is therefore an object of the present invention to provide a mailbox that automatically alerts a user whenever mail is delivered.

It is therefore another object of the present invention to provide a mailbox having a delivery indicator that is automatically deployed when an access door is opened.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
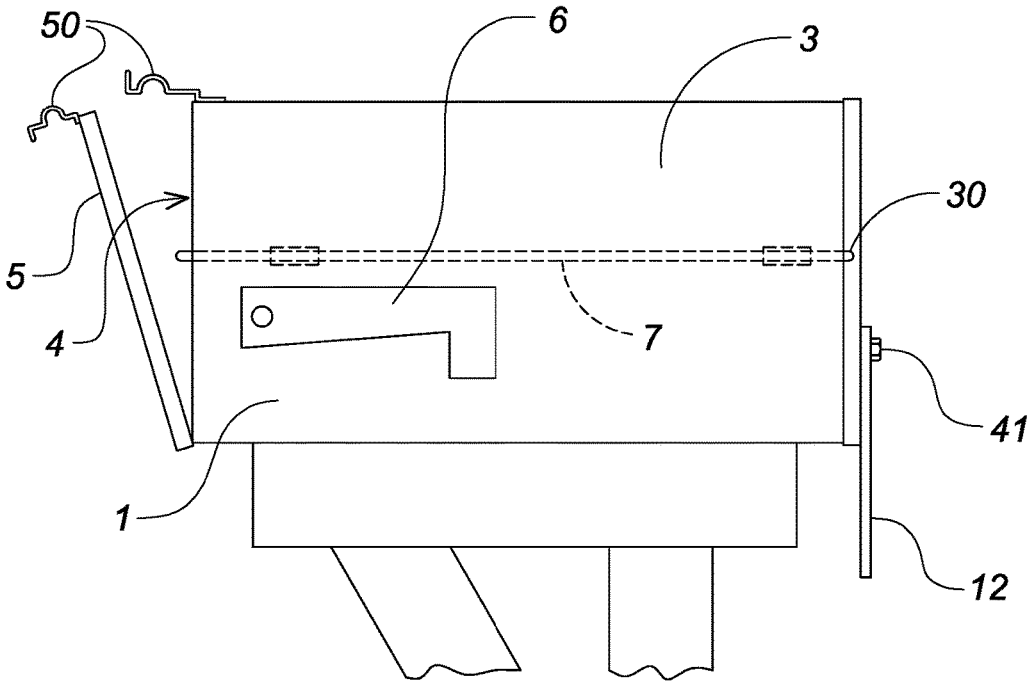
FIG. 1 is a side, plan view of the mailbox according to the present invention.
Figure 2:
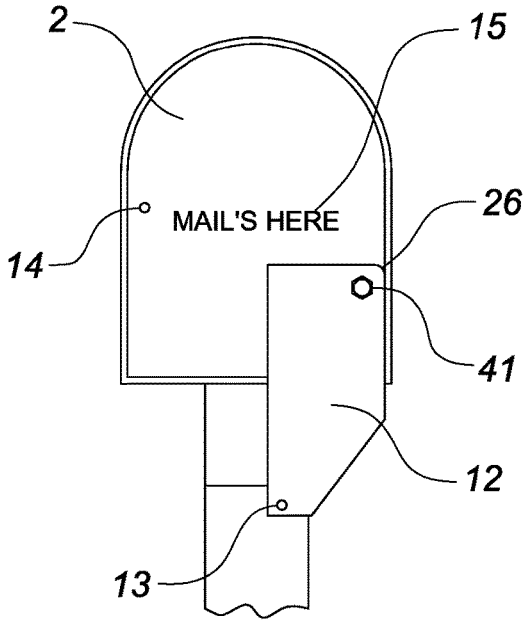
FIG. 2 is a rear view of the mailbox.
Figure 3:
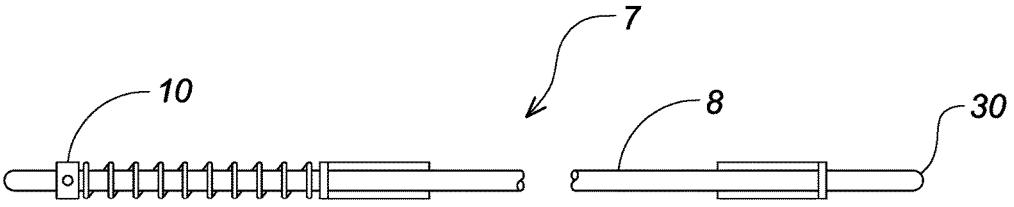
FIG. 3 is an isolated, top view of the actuator.
Figure 4:
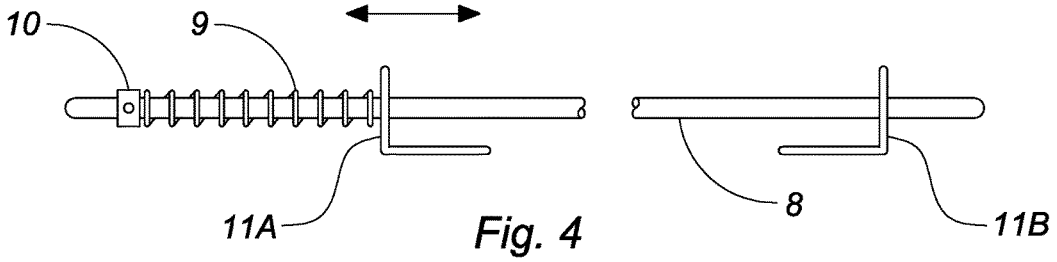
FIG. 4 is an isolated, side view of the actuator.

The present invention relates to a mailbox comprising a hollow housing 1 having a rear wall 2, an outer wall 3, a bottom surface and an open front 4 in communication with an interior mail receptacle. An access door 5 is pivotal onto and away from the open front to provide selective access to the mail receptacle. A flag 6 is pivotally mounted on the outer wall exterior to notify a mail carrier that the box contains outgoing mail.

Figure 5:
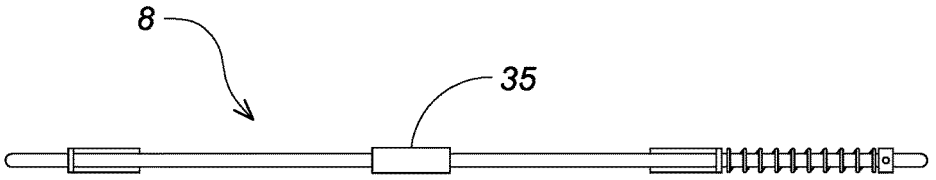
FIG. 5 is a plan view of a slightly different embodiment of the actuator.
Figure 6:
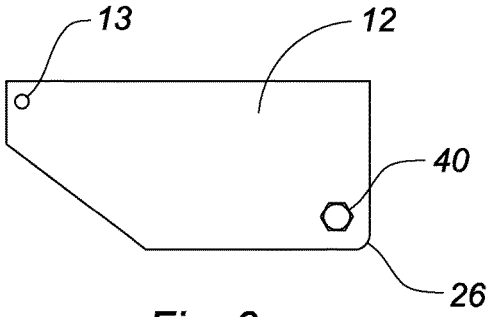
FIG. 6 is an isolated view of the delivery indicator.

Within the mail receptacle is an actuator 7 for deploying a delivery indicator plate 12 when the access door is opened. The actuator includes an elongated rod 8 attached to the interior surface of the outer wall with a pair of L-shaped mounting brackets 11A, 11B. The rod includes a spring 9 positioned between a collar 10 and a forward bracket 11A to bias the rod toward the access door. As depicted in FIG. 5, the rod may include a coupling 35 for varying the length to adjust the sensitivity of the rod relative to door movement.

The delivery indicator plate 12 includes a hole 40 near a lower corner 26 that receives a fastener 41 to pivotally couple the plate to the housing so that it automatically pivots downwardly when released. The plate 12 also includes an aperture near 13 an opposing side that selectively aligns with an opening 14 on the housing rear wall for receiving a distal end of the rod to maintain the indicator in a substantially horizontal, raised and neutral position. Preferably, the distal end 30 of the rod is rounded or tapered to facilitate insertion into the aperture and opening.

Accordingly, each time a user retrieves mail, he or she closes the door and forces the spring-biased rod through the aligned aperture and opening to fix the indicator in the raised, neutral position. When a mail carrier opens the door to deliver mail, the spring-biased rod automatically moves forward to release the plate. The plate automatically pivots downwardly to a vertical position, extending below the bottom surface of the housing, to conspicuously notify a user that mail has been delivered. The released plate also exposes a textual alert message 15 inscribed on the housing rear wall.

The above-described device is not limited to the exact details of construction and enumeration of parts provided herein. For example, though the rod has been primarily depicted and described as releasing a pivotal indicator plate, it could also have a switch mechanism for activating an LED to emit light through the opening, or to activate an LED on the housing rear wall. In addition, the access door could be equipped with a magnetic latch that is less obtrusive than the conventional closure mechanism 50. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mailbox with delivery indicator comprising:

a hollow housing having a rear wall, at least one outer wall and an open front in communication with an interior mail receptacle;

an access door pivotal onto and away from the open front to provide selective access to the mail receptacle;

a plate mounted on said housing, said plate fixed in a neutral, raised position when said access door is pivoted onto the open front;

an elongated rod received within said mail receptacle and attached to an inner surface of the outer wall, said rod biased toward said access door, said rod having a distal end that passes through an opening on said housing and an aligned aperture on said plate when said plate is in a neutral, raised position whereby when said access door is pivoted away from the open front, the biased rod moves toward said door to remove the distal end from said opening and said aperture to release said plate, which pivots to an active, lowered position to indicate that mail has been placed into said mail receptacle;

a textual alert message inscribed on the rear wall of said housing that is concealed when said plate is in the neutral, raised position, said textual alert message exposed when said plate is released to said active, lowered position to further inform a user that mail has been placed into said mail receptacle.

2. The mailbox according to claim 1 further comprising a means for varying a length of said rod to adjust a degree of movement of said rod when said access door is pivoted away from the open front.

3. The mail box according to claim 2 wherein the means for varying a length of said rod comprises said rod being formed of two sections, a first end of one of said sections being adjustably joined to an end of another of said sections with a coupling.

4. The mail box according to claim 1 wherein said plate includes a linear top edge, two linear side edges and a lower edge having a linear portion parallel to the top edge and an oblique portion that extends from the linear portion to one of said side edges to render said plate top heavy to facilitate lowering to the active position when released.

* * * * *